US007661781B2

(12) United States Patent
Onozawa

(10) Patent No.: US 7,661,781 B2
(45) Date of Patent: Feb. 16, 2010

(54) LIQUID EJECTION HEAD AND IMAGE FORMING APPARATUS

(75) Inventor: Sho Onozawa, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 286 days.

(21) Appl. No.: 11/654,631

(22) Filed: Jan. 18, 2007

(65) Prior Publication Data

US 2007/0171244 A1 Jul. 26, 2007

(30) Foreign Application Priority Data

Jan. 20, 2006 (JP) ..... 2006-012750

(51) Int. Cl.
*B41J 29/38* (2006.01)
*B41J 2/045* (2006.01)

(52) U.S. Cl. ..... 347/9; 347/68

(58) Field of Classification Search ..... 347/9, 347/68

See application file for complete search history.

(56) References Cited

U.S. PATENT DOCUMENTS 5,453,767 A 9/1995 Chang et al.

6,481,073 B1 * 11/2002 Sugahara ..... 29/25.35

FOREIGN PATENT DOCUMENTS

JP 7-76087 A 3/1995

OTHER PUBLICATIONS

Dynamics of Heterogenous Materials; By: V.F. Nesterenko Published by Springer 2001 p. 46, section 1.6.8.6.*

* cited by examiner

*Primary Examiner*—Julian D Huffman
*Assistant Examiner*—Jason S Uhlenhake
(74) *Attorney, Agent, or Firm*—Birch, Stewart, Kolasch & Birch, LLP

(57) ABSTRACT

The liquid ejection head includes: a liquid flow channel of which at least one wall is constituted by an elastic member; a nozzle which is provided at an end of the liquid flow channel; and a pressure generating device which generates a pressure pulse wave in liquid inside the liquid flow channel. The liquid flow channel and the pressure generating device are composed in such a manner that the pressure pulse wave propagates as a soliton through the liquid in the liquid flow channel.

3 Claims, 5 Drawing Sheets

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly, to a liquid ejection head having a liquid flow channel (nozzle flow channel) of which at least one wall surface is constituted by an elastic member.

2. Description of the Related Art

In the related art, an inkjet recording apparatus is known which includes a liquid ejection head (hereinafter referred simply to as "head") having a plurality of nozzles, and which records images onto a recording medium by ejecting ink droplets from the nozzles toward the recording medium. One type of head is, for example, a piezoelectric type which pressurizes ink inside pressure chambers through the deformation of actuators, which are typically piezoelectric elements, thereby ejecting droplets of the ink from nozzles connected to the pressure chambers.

In recent years, there have been demands for recording images of high resolution and high definition at high speed, and hence the development of heads capable of ejecting very small droplets of high-viscosity inks having various additional functions has become necessary. However, if it is sought to eject very small droplets (for example, approximately 0.5 pl (picoliters) each) of ink having high-viscosity (for example, approximately 5 to 10 cP (centipoises)) with the piezoelectric type head in the related art, then various problems such as the following arise.

In a piezoelectric type head in the related art, a phenomenon (commonly called "trailing") is liable to occur in which an ink droplet ejected from a nozzle forms a column shape trailing behind during its flight, and very small ink droplets (hereinafter referred to as "satellite droplets") following the main ink droplet are thereby generated. The satellite droplets are deposited on the recording medium and lead to a decline in image quality. In order to prevent the generation of the satellite droplets, in Japanese Patent Application Publication No. 7-76087, for example, an ink droplet is ejected by switching the rates of drive voltage change of the actuator in two stages. However, in cases of increased viscosity of the ink, the ink column becomes longer and velocity distribution inside the ink column also becomes scattered, leading to the possible generation of a large number of satellite droplets. Moreover, if the ink droplet intendedly ejected from the nozzle is made very small in size, then the ink column itself becomes narrower, and satellite droplets become more liable to be generated, due to the effect of the Rayleigh-Taylor instability. Therefore, when ejecting a very small droplet of ink having high viscosity, it is difficult to prevent the occurrence of the trailing phenomenon, even if the actuator drive voltage is controlled in the method as disclosed in Japanese Patent Application Publication No. 7-76087.

In order to enable the ejection of high-viscosity ink, it is necessary to raise the power of the actuators, for instance, by increasing the number of layers of laminated piezoelectric body, or by raising the drive voltage; however, both manners have their limits on raising the power of the actuators. Moreover, there is also the problem of reduced ejection frequency due to delays in refilling.

In order to enable the ejection of very small droplets, it is also necessary to raise the drive frequency of the actuators. In a piezoelectric type head according to the related art, ejection is carried out by using what is known as full system resonance, whereby ink is ejected by controlling the drive frequency of the actuators in such a manner that the drive frequency substantially coincides with the resonance frequency of the ink inside the head (i.e., inside pressure chambers). Therefore, in order to increase the drive frequency of the actuators, it is necessary to increase the resonance frequency of the pressure chambers by reducing the size (volume) of the pressure chambers, and this leads to major restrictions on the design of the head.

As described above, in the piezoelectric type heads according to the related art, various problems arise when very small droplets of ink having high viscosity are sought to be ejected, and therefore it has been extremely difficult to achieve ejection of fine droplets of ink having high viscosity.

SUMMARY OF THE INVENTION

The present invention has been contrived in view of the foregoing circumstances, an object thereof being to provide a liquid ejection head and an image forming apparatus whereby very small droplets of liquid having high viscosity can be ejected, and desirable image quality can be achieved.

In order to attain the aforementioned object, the present invention is directed to a liquid ejection head, comprising: a liquid flow channel of which at least one wall is constituted by an elastic member; a nozzle which is provided at an end of the liquid flow channel; and a pressure generating device which generates a pressure pulse wave in liquid inside the liquid flow channel, wherein the liquid flow channel and the pressure generating device are composed in such a manner that the pressure pulse wave propagates as a soliton through the liquid in the liquid flow channel.

According to this aspect of the present invention, it is possible to make the pressure pulse wave efficiently propagate as the soliton through the liquid in the liquid flow channel, and moreover, it is possible to create a droplet of the liquid while preventing excessive growth of the liquid column, due to the soliton breaking at the nozzle located at the end of the liquid flow channel. Consequently, it is possible to eject very small droplets of liquid having high viscosity from the nozzle, and therefore desirable image quality can be achieved.

Preferably, the liquid flow channel is formed in a substantially cylindrical shape; and the liquid flow channel and the pressure generating device are composed in such a manner that the following relationships are satisfied:

$$w = a\sqrt{\frac{h\rho_R}{r_0\rho_0}},$$

$$v = \sqrt{\frac{Eh}{2\rho_0 a}}\left(1 + \frac{r_0}{a}\right),$$

$$V \cong \pi(a + r_0)^2 w,$$

and $$V \cong \frac{\pi}{6}w^3,$$

where w is a full-width at half-maximum of the pressure pulse wave propagating through the liquid in the liquid flow channel, v is a speed of the pressure pulse wave, a is a radius of the liquid flow channel, h is a thickness of the wall of the liquid flow channel, $r_0$ is a maximum amplitude of the pressure pulse wave, $\rho_R$ is a density of the wall of the liquid flow channel, $\rho_0$ is a density of the liquid in the liquid flow channel, and E is a Young's modulus of the wall of the liquid flow channel.

Preferably, the liquid ejection head in the present invention further comprises: a liquid flow channel forming member which has a groove serving as the liquid flow channel, wherein the elastic member is arranged on a surface of the liquid flow channel forming member on which the groove is formed.

Thereby, the structure is simplified and excellent manufacturability is obtained.

In order to attain the aforementioned object, the present invention is also directed to an image forming apparatus including a liquid ejection head, comprising: a liquid flow channel of which at least one wall is constituted by an elastic member; a nozzle which is provided at an end of the liquid flow channel; and a pressure generating device which generates a pressure pulse wave in liquid inside the liquid flow channel, wherein the liquid flow channel and the pressure generating device are composed in such a manner that the pressure pulse wave propagates as a soliton through the liquid in the liquid flow channel.

According to the present invention, it is possible to make a pressure pulse wave efficiently propagate as a soliton through liquid in a liquid flow channel, and furthermore, it is possible to create a droplet of the liquid while preventing excessive growth of the liquid column, due to the soliton breaking at the nozzle section located at an end of the liquid flow channel. Consequently, it is possible to eject very small droplets of liquid having high viscosity from the nozzle, and therefore desirable image quality can be achieved.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
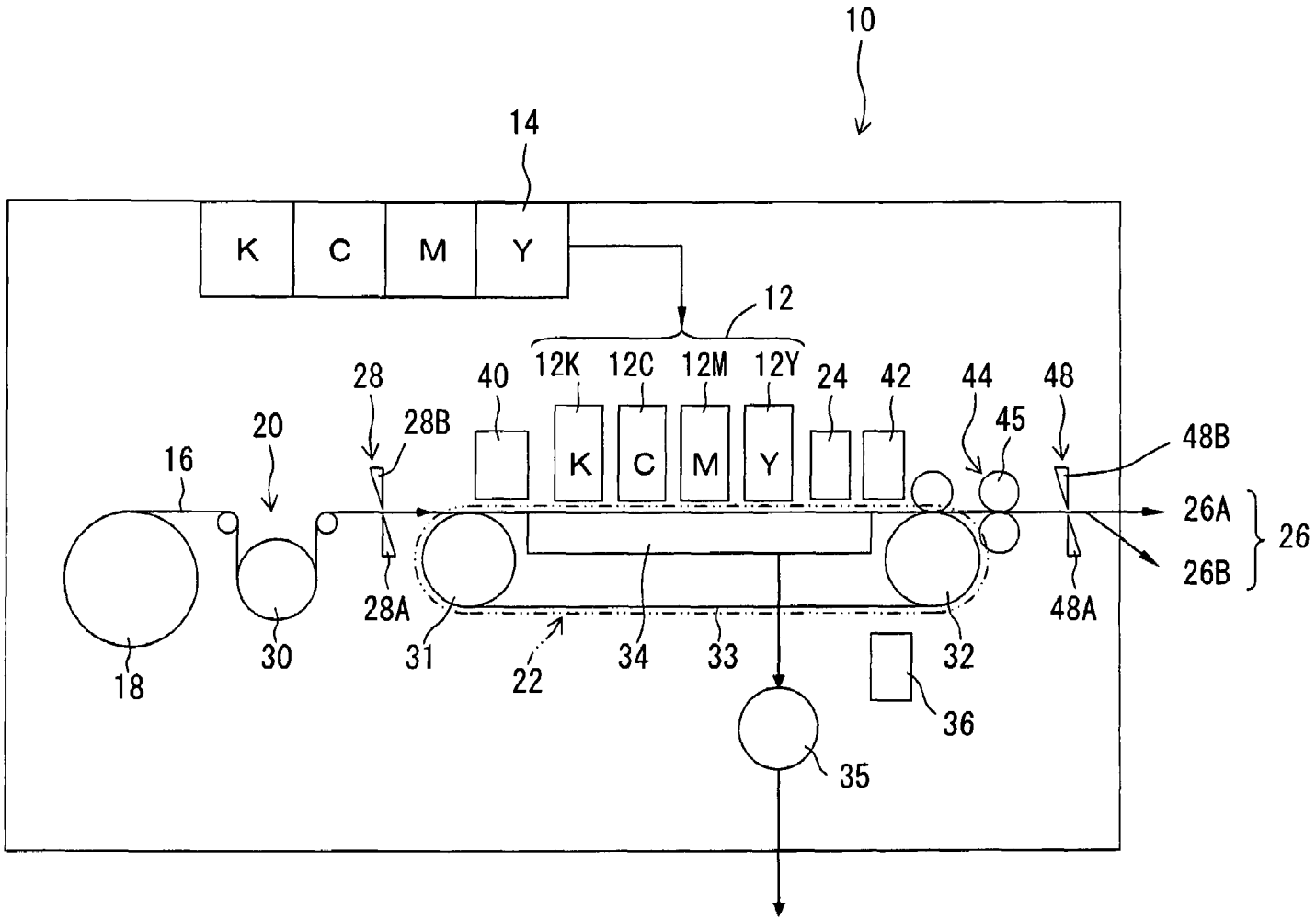
FIG. 1 is a general schematic drawing showing a general view of an inkjet recording apparatus according to an embodiment of the present invention.

FIG. 1 is a diagram of the general composition showing a schematic illustration of an inkjet recording apparatus according to an embodiment of the present invention. As shown in FIG. 1, the inkjet recording apparatus 10 comprises: a printing unit 12 having a plurality of heads 12K, 12C, 12M, and 12Y for ink colors of black (K), cyan (C), magenta (M), and yellow (Y), respectively; an ink storing and loading unit 14 for storing inks of K, C, M, and Y to be supplied to the heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown in drawings) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration of nipping with cleaning rollers with a brush roller and a water absorbent roller, an air blow configuration in which clean air is blown, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub-scanning direction). The heads 12K, 12C, 12M, and 12Y forming the print unit 12 are constituted by line heads in which ink ejection ports (nozzles) are arranged through a length exceeding at least one edge of the maximum size recording paper 16 intended for use with the inkjet recording apparatus 10.

The heads 12K, 12C, 12M, and 12Y corresponding to respective ink colors are disposed in the order, black (K), cyan (C), magenta (M), and yellow (Y), from the upstream side (the left-hand side in FIG. 1), following the direction of conveyance of the recording paper 16 (the paper conveyance direction). A color print can be formed on the recording paper 16 by ejecting the inks from the heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a head moves reciprocally in a direction (main scanning direction) that is perpendicular to the paper conveyance direction.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added.

As shown in FIG. 1, the ink storing and loading unit 14 has ink tanks for storing the inks of the colors corresponding to the respective heads 12K, 12C, 12M, and 12Y, and the respective tanks are connected to the heads 12K, 12C, 12M, and 12Y by means of channels (not shown). The ink storing and loading unit 14 has a warning device (for example, a display device, an alarm sound generator or the like) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming into contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in drawings, the paper output unit 26A for the target prints is provided with a sorter for collecting prints according to print orders.

Next, the composition of the heads 12K, 12C, 12M, and 12Y is described. The heads 12K, 12C, 12M, and 12Y of the respective ink colors have the same composition, and a reference numeral 50 is hereinafter used to designate a representative embodiment of the heads.

Figure 2A:
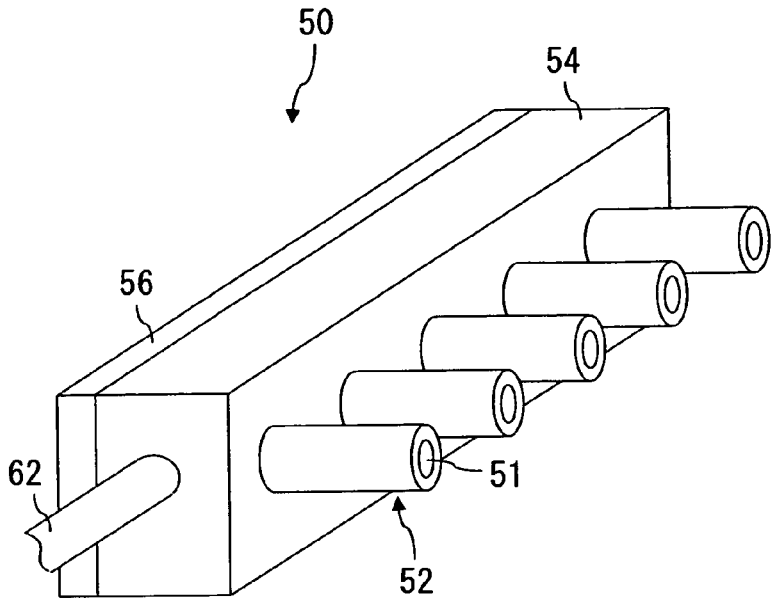
FIGS. 2A and 2B are illustrative diagrams showing the composition of an inkjet recording head in the inkjet recording apparatus.
Figure 2B:
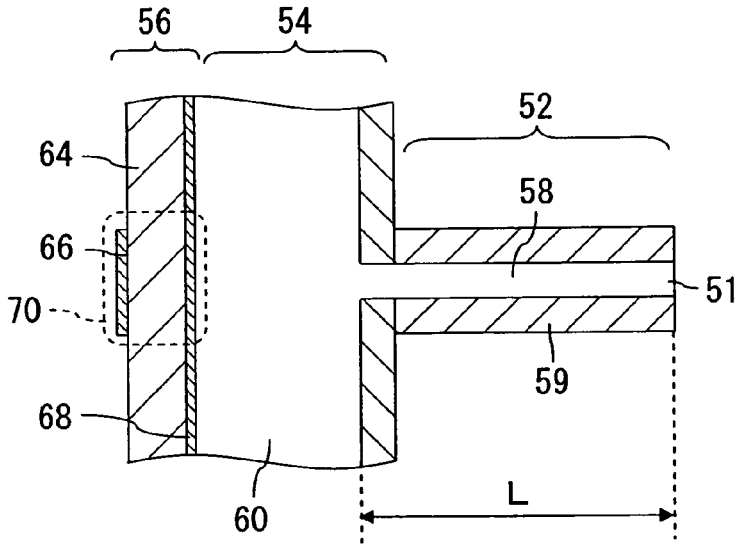

FIGS. 2A and 2B are illustrative diagrams showing the composition of a head 50, wherein FIG. 2A is an external oblique diagram, and FIG. 2B is a partial cross-sectional diagram. The head 50 is provided with a plurality of nozzle flow channel forming members 52 having a cylindrical shape, which are aligned in the lengthwise direction of the head 50. In FIG. 2A, for the sake of convenience, five of the nozzle flow channel forming members 52 are depicted, but in practice, a very large number of nozzle flow channel forming members 52 are arranged. The nozzle flow channel forming members 52 are fixed to a surface of a common flow channel forming member 54, and a piezoelectric actuator 56 (pressure generating device) is arranged on the reverse surface (i.e., the surface of the common flow channel forming member 54 reverse to the surface on which the nozzle flow channel forming members 52 are arranged).

As shown in FIG. 2B, a cylindrical nozzle flow channel 58 (liquid flow channel) is formed inside each of the nozzle flow channel forming members 52. The cylindrical nozzle flow channel 58 extends in the axial direction of the nozzle flow channel forming member 52. The opening formed at an end of each nozzle flow channel 58 serves as a nozzle 51 for ejecting ink droplets. The other end of the nozzle flow channel 58 is connected to a common flow channel 60. The common flow channel 60 corresponds to the space created when a recess part formed in the common flow channel forming member 54 is covered with the piezoelectric actuator 56. Ink is supplied from the ink storing and loading unit 14 shown in FIG. 1 through a tubing channel 62, and is then accumulated in the common flow channel 60.

The piezoelectric actuator 56 is constituted by a flat plate-shaped piezoelectric body 64, and individual electrodes 66 and a common electrode 68, which are respectively arranged on opposite surfaces of the piezoelectric body 64. The individual electrode 66 is provided for each nozzle 51 (i.e., for each nozzle flow channel 58), and is disposed on the surface of the piezoelectric body 64 reverse to the surface adjacent to the common flow channel 60, in a position opposing each nozzle flow channel 58. The common electrode 68 is formed over the whole of the surface of the piezoelectric body 64 on the side adjacent to the common flow channel 60. An insulating protective film (not shown) of resin, or the like, is formed on the surface of the common electrode 68, thereby preventing the common electrode 68 from coming in contact with the ink accumulated inside the common flow channel 60.

The region of the piezoelectric body 64 interposed between each individual electrode 66 and the common electrode 68 forms a displacement generating unit 70, which generates a prescribed displacement when a voltage is applied between the corresponding individual electrode 66 and the common electrode 68. In the present embodiment, a composition is adopted in which the common electrode 68 is grounded at a position not shown in FIGS. 2A and 2B, and a prescribed drive voltage is applied to each individual electrode 66 by a drive circuit (not shown). When the drive voltage is applied to one of the individual electrodes 66, the corresponding displacement generating unit 70 is deformed so as to bend toward the nozzle flow channel 58, which is located in an opposing position on the other side of the common flow channel 60. Thereby, a pressure pulse wave is introduced into the nozzle flow channel 58 through the ink inside the common flow channel 60, and this pressure pulse wave propagates through the ink inside the nozzle flow channel 58, and a droplet of the ink is ejected from the nozzle 51 located at the end of the nozzle flow channel 58.

One of characteristic features in the present invention is that the nozzle flow channels 58 and the piezoelectric actuators 56 are constituted in such a manner that the pressure pulse waves propagate as solitons through the liquid (ink) in the nozzle flow channels 58. It is thus possible to eject very small droplets of high-viscosity ink while preventing the phenomenon of trailing, more specifically, the occurrence of satellite droplets.

Figure 3:
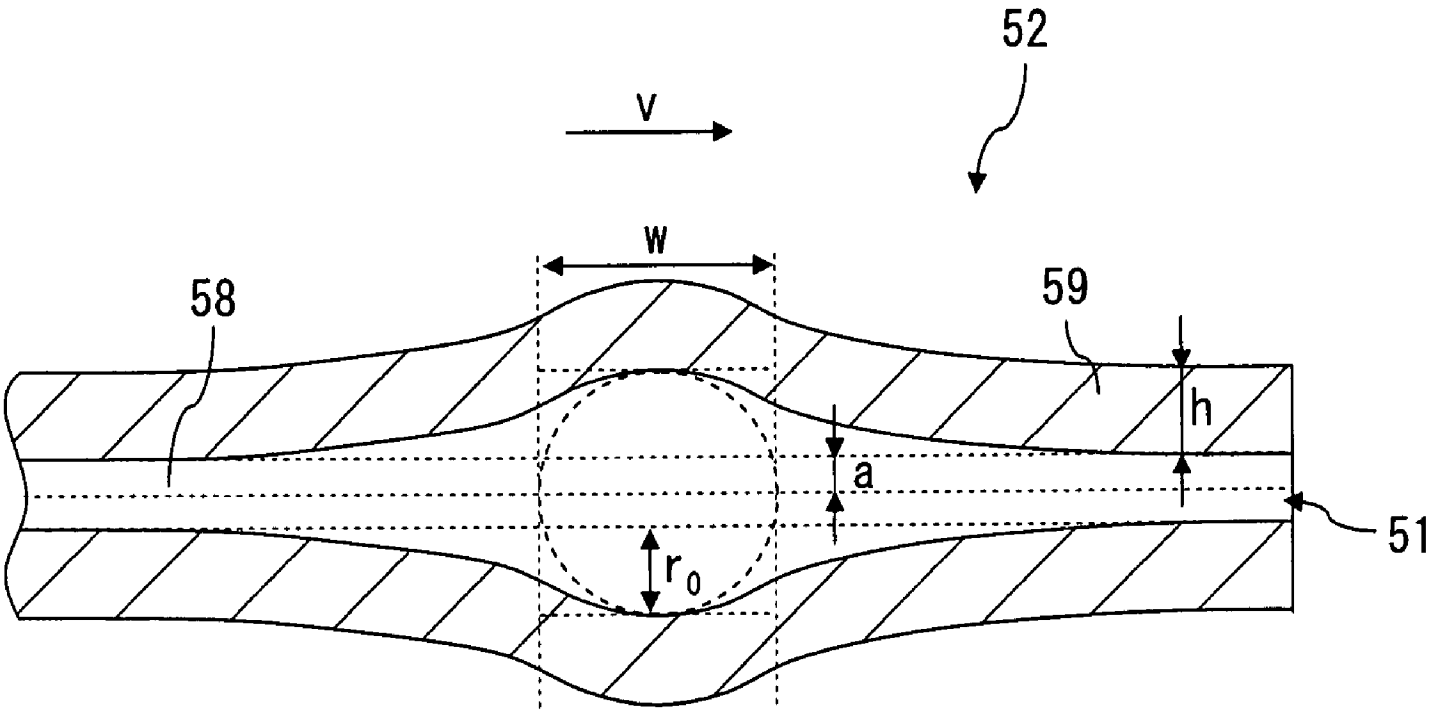
FIG. 3 is a partial cross-sectional diagram of a nozzle flow channel forming member.

Specific conditions of the composition of the nozzle flow channels 58 and the piezoelectric actuators 56 are described below. FIG. 3 is a partial cross-sectional diagram of the nozzle flow channel forming member 52. Firstly, it is generally known that when a pressure pulse wave propagates through the liquid in the nozzle flow channel 58, the following relationships are established:

$$w = a\sqrt{\frac{h\tilde{\rho}_R}{r_0\tilde{\rho}_0}}; \tag{1}$$

and $$\tilde{v} = \sqrt{\frac{\tilde{E}h}{2\tilde{\rho}_0 a}\left(1 + \frac{r_0}{a}\right)}, \tag{2}$$

where w is the full-width at half-maximum (FWHM) of the pressure pulse wave, $\tilde{v}$ is the speed of the pressure pulse wave, a is the radius of the nozzle flow channel 58, h is the thickness of a wall 59 of the nozzle flow channel 58, $\tilde{\rho}_R$ is the density of the nozzle flow channel wall 59, $r_0$ is the maximum amplitude of the pressure pulse wave, $\tilde{\rho}_0$ is the density of the liquid (ink) in the nozzle flow channel 58, and $\tilde{E}$ is the Young's modulus of the nozzle flow channel wall 59. Here, the variables capped with the symbol "~" are known quantities, and the other variables are unknown quantities.

In this case, the volume $\tilde{V}$ of a droplet of the liquid ejected is assumed to be expressed as:

$$\tilde{V} \cong \pi(a+r_0)^2 w. \tag{3}$$

Moreover, the full-width at half-maximum w of the pressure pulse wave is assumed to be approximately equal to the diameter of the ejected droplet of the liquid, in other words, the volume of the ejected droplet is assumed as:

$$\tilde{V} \cong \frac{\pi}{6} w^3. \tag{4}$$

Here, the known quantities shown in the following Table 1 are used for calculation.

TABLE 1

| $\tilde{v}$ (m/s) | $\tilde{V}$ (pl) | $\tilde{\rho}_0$ (kg/m$^3$) | $\tilde{\rho}_R$ (kg/m$^3$) | $\tilde{E}$ (MPa) |
|---|---|---|---|---|
| 1500 | 0.5 | 1000 | 8000 | 200 |

By solving the above-described formulas (1) to (4) for the unknown quantities with the known quantities in Table 1, the results shown in the following Table 2 are obtained. Here, the formulas (3) and (4) are assumed to be equations.

TABLE 2

| w (μm) | a (μm) | h (μm) | $r_0$ (μm) |
|---|---|---|---|
| 9.85 | 1.81 | 8.22 | 2.21 |

Hence, if using the piezoelectric actuator 56 (for example, an ultrasonic element) that satisfies drive conditions where the pressure pulse wave propagating through the liquid in the nozzle flow channel 58 has a velocity v of 1500 m/s, then by composing the nozzle flow channel forming substrate 52 from a material having the bending rigidity equivalent of stainless steel, and by setting the thickness h of the nozzle flow channel wall 59 to 8 μm and the radius of the nozzle flow channel 58 to 1.8 μm, it is possible to make the pressure pulse wave introduced into the nozzle flow channel 58 propagate with good efficiency in the form of a soliton having the full-width at half-maximum of 10 μm, and the soliton breaking at the nozzle 51 positioned at the end of the nozzle flow channel 58 leads to the generation of a droplet of the liquid (ink) having the volume of approximately 0.5 pl, while preventing excessive growth of the liquid column.

Moreover, if the ejection frequency is taken to be f, then the period at which the pressure pulse waves are outputted in order to trigger the solitons is T=1/f. If the outputted pressure pulse wave (soliton) reaches the nozzle 51 at the end of the nozzle flow channel 58 within this period, then there is a possibility that the reflection of this preceding soliton reflected at the nozzle will collide with the subsequent soliton in the nozzle flow channel 58. Hence, although there is little interaction between solitons colliding with each other, it is desirable to adopt a design that avoids the coexistence of a plurality of solitons in the nozzle flow channel 58, in order to prevent as far as possible any reduction in the propagation speed of the solitons. That is, it is desirable that the flow channel length L of the nozzle flow channel 58 (see FIG. 2B) satisfies the following inequality:

$$L \leq \frac{v}{2f}. \tag{5}$$

For example, in a case where the ejection frequency f is 100 kHz, it is desirable that the flow channel length L of the nozzle flow channel 58 is not longer than 7.5 mm, in accordance with the inequality (5).

According to the first embodiment, by composing the nozzle flow channels 58 and the piezoelectric actuators 56 so as to satisfy the above-described relationships (1) to (4), it is possible to make the pressure pulse waves efficiently propagate as solitons through the liquid (ink) in the nozzle flow channels 58. Furthermore, since the soliton is used and therefore the liquid region carrying the momentum is localized, it is possible to achieve a very small droplet size when a droplet of the liquid is formed, and it is possible to reduce the trailing phenomenon caused by excessive growth of the liquid column. Consequently, it is possible to prevent the occurrence of satellite droplets and to eject a very small droplet of high-viscosity liquid from the nozzle, and hence a desirable image quality can be achieved.

In the head 50 according to the present embodiment, it is not necessary to make the drive frequency of the piezoelectric actuators 56 coincide with the resonance frequency of the liquid (ink) inside the head 50. Hence, driving at the resonance frequency of the piezoelectric actuators 56 themselves becomes possible, and higher-frequency ejection can be achieved in comparison with a piezoelectric head in the related art. In particular, since highly efficient propagation is achieved due to the soliton effect and the streaming effect (the effect of pushing the liquid through the radiated pressure) created by using a frequency in the ultrasonic range, then it is possible to improve refilling characteristics in cases where ink of high viscosity is used.

The first embodiment is described as the embodiment in which nozzle flow channels 58 are arranged in one row following the lengthwise direction of the head 50, but there is also a mode in which the nozzle flow channels 58 are arranged in a plurality of rows.

Second Embodiment

Next, a second embodiment of the present invention is described. Below, the parts of the second embodiment common to the first embodiment described above are not described, and the explanation focuses on the characteristic features of the second embodiment.

Figure 4:
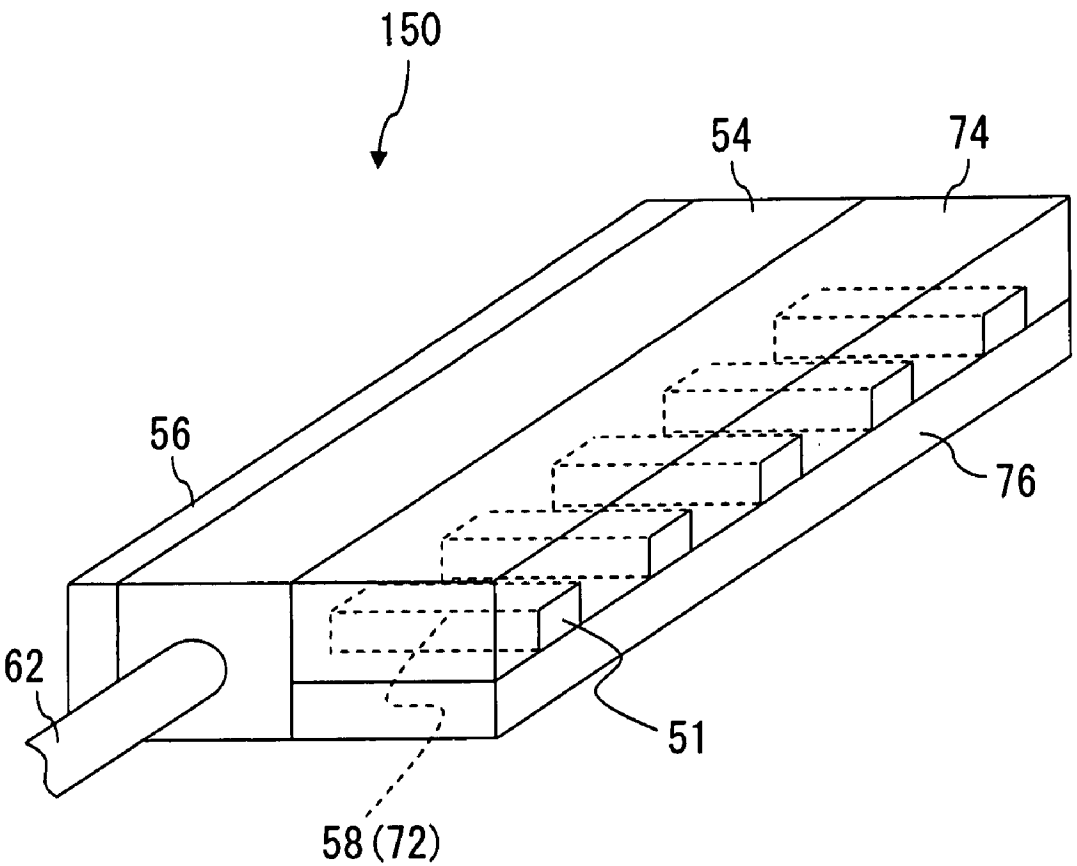
FIG. 4 is an external oblique diagram of an inkjet recording head according to a second embodiment.

FIG. 4 is an external oblique diagram of a head 150 according to the second embodiment. In FIG. 4, members which are common to those in FIGS. 2A and 2B are denoted with the same reference numerals. A nozzle flow channel forming member 74 constitutes a portion of the head 150, and is formed with a plurality of groove sections 72 corresponding to the nozzle flow channels 58. A plate-shaped elastic member 76 of stainless steel (SUS) or the like covers the openings of the groove sections 72. The nozzle flow channels 58 constituted in this way have a square cross-sectional shape in the direction perpendicular to their axial direction.

According to the second embodiment, although the propagation characteristics of the pressure pulse waves through the liquid in the nozzle flow channels 58 are slightly inferior to the first embodiment, it is still possible to eject very small droplets of high-viscosity liquid from the nozzles 51 while preventing the trailing phenomenon. In particular, in the second embodiment, by adopting the mode in which one wall of the nozzle flow channels 58 is constituted by the elastic member 76, the structure is simplified and the composition having even better manufacturability is obtained.

In the present embodiment, the mode is described in which one wall of the nozzle flow channels 58 is constituted by the elastic member 76, but the implementation of the present invention is not limited to this. For example, in a modification embodiment of the second embodiment, it is also possible to compose both of the opposing walls of the nozzle flow channels 58 from elastic members 76 (76A and 76B), as in a head 150' shown in FIG. 5.

Figure 5:
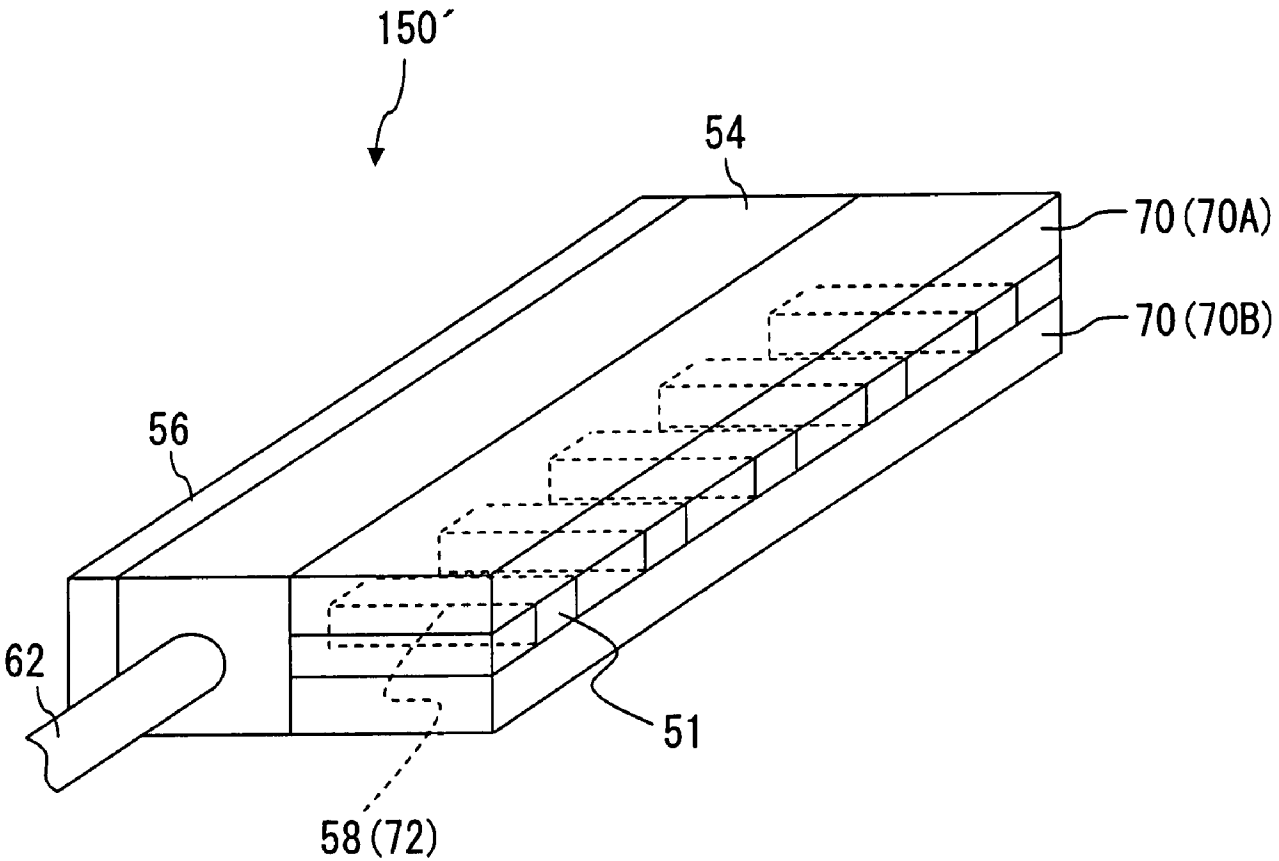
FIG. 5 is an external oblique diagram of an inkjet recording head according to a modification of the second embodiment.

Furthermore, although not shown in FIGS. 4 and 5, it is also possible to compose the walls between the mutually adjacent nozzle flow channels 58 from elastic members.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a liquid flow channel of which at least one wall is constituted by an elastic member;

a nozzle which is provided at an end of the liquid flow channel; and a pressure generating device which generates a pressure pulse wave in liquid inside the liquid flow channel, wherein the liquid flow channel and the pressure generating device are composed in such a manner that the pressure pulse wave propagates as a soliton through the liquid in the liquid flow channel, and wherein:

the liquid flow channel is formed in a substantially cylindrical shape; and the pressure generating device includes a controller which controls a full-width at half-maximum of the pressure wave propogating through the liquid in the liquid flow channel and a maximum amplitude of the pressure wave in such a manner that the following relationships are satisfied:

$$w = a\sqrt{\frac{h\rho_R}{r_0\rho_0}},$$

$$v = \sqrt{\frac{Eh}{2\rho_0 a}}\left(1 + \frac{r_0}{a}\right),$$

$$V \cong \pi(a + r_0)^2 w,$$

and

-continued $$V \cong \frac{\pi}{6}w^3,$$

where w is the full-width at half-maximum of the pressure pulse wave propagating through the liquid in the liquid flow channel, v is a speed of the pressure pulse wave, a is a radius of the liquid flow channel, h is a thickness of the wall of the liquid flow channel, $r_0$ is the maximum amplitude of the pressure pulse wave, $\rho_R$ is a density of the wall of the liquid flow channel, $\rho_0$ is a density of the liquid in the liquid flow channel, and E is a Young's modulus of the wall of the liquid flow channel.

2. The liquid ejection head as defined in claim 1, further comprising:

a liquid flow channel forming member which has a groove serving as the liquid flow channel, wherein the elastic member is arranged on a surface of the liquid flow channel forming member on which the groove is formed.

3. An image forming apparatus comprising the liquid ejection head as defined in claim 1.

* * * * *